United States Patent [19]

Masci

[11] 4,041,737

[45] Aug. 16, 1977

[54] CLOTHES WATER EXTRACTING MACHINE

[75] Inventor: Saturno Angelo Masci, Bedford, Mass.

[73] Assignee: Walter J. Kreske, Newton, Mass.

[21] Appl. No.: 445,801

[22] Filed: Feb. 25, 1974

[51] Int. Cl.[2] ..... D08F 47/00

[52] U.S. Cl. ..... 68/242

[58] Field of Search ..... 68/242; 4/79; 200/84 C

[56] References Cited

U.S. PATENT DOCUMENTS

| | | | |
|---|---|---|---|
| 2,428,710 | 10/1947 | Jorgenson et al. | 68/242 |
| 2,538,403 | 1/1951 | Watson | 68/242 X |
| 2,593,292 | 4/1952 | Gaugler | 68/242 X |
| 2,955,452 | 10/1960 | Myers | 68/242 |
| 3,112,497 | 12/1963 | Call | 4/115 X |
| 3,437,771 | 4/1969 | Nusbaum | 200/84 C |
| 3,535,712 | 10/1970 | Zeff et al. | 4/10 |
| 3,870,844 | 3/1976 | Frees | 200/84 C |
| Re. 27,681 | 6/1973 | Gaddis | 259/95 |

*Primary Examiner*—Edward J. McCarthy
*Attorney, Agent, or Firm*—Walter J. Kreske

[57] ABSTRACT

In a laundry clothes water extracting machine of the type having a flexible diaphragm with an outer and inner surfaces and the inner surface forming a receptacle for receiving wet clothes for extraction of water therefrom, a water carrying reservoir, a rigid housing about the outside surface of the flexible diaphragm, and a pump arrangement for pressurably applying the reservoir water to the space between the outside surface of the diaphragm and the rigid housing to thereby cause the diaphragm to compress against the wet clothes and squeeze the clothes water therefrom and thereafter to return the pressurably applied reservoir water back to the reservoir; the combination of a 24 volt solenoid operated water valve having an inlet coupled to a conventional pressurized water supply and an outlet coupled for supplying water from the pressurized water supply to the reservoir, a step-down transformer with a primary coupled to a conventional A.C. power source and a secondary in a circuit across the solenoid for 24 volt output to the solenoid, and a float operable switch in the reservoir coupled to the 24 volt output circuit to the solenoid for closing the electric output circuit to the solenoid and thereby causing the water valve to open for conventional water supply flow to the reservoir when the reservoir water level falls below a safe level needed to supply the pump arrangement and to open the electric output circuit to the solenoid when the reservoir water level rises to an upper water level for insuring sufficient reservoir water to supply the pump arrangement.

5 Claims, 2 Drawing Figures

CLOTHES WATER EXTRACTING MACHINE

BACKGROUND OF THE INVENTION

This invention relates to improvements in clothes water extracting machines of the type having a water reservoir for storing water which is periodically used to create pressure against the outside surface of a flexible diaphragm to cause the diaphragm to collapse against wet clothes and to thereby squeeze the clothes water therefrom, and more particularly to flexible diaphragm type clothes water extracting machines which include pumping equipment for transferring the water from the reservoir and pressurably applying it to the flexible diaphragm in a clothes water extraction cycle and thereafter returning the so pressurably applied reservoir water back to the reservoir for reuse in a subsequent similar clothes water extraction cycle.

It has been found that articles such as nails, pins or other sharp objects often are inadvertently left in laundered clothing and cause holes in the flexible diaphragm when pressurably collapsed against the clothes during the clothes water extracting cycle. Such resulting leaks in the flexible diaphragm cause loss of reservoir water. Because of the need for relatively high pressures, up to 400 pounds per square inch, for efficient clothes water extraction in the extraction cycle, even small pin holes in the flexible diaphragm cause serious loss of reservoir water during each extraction cycle. This reservoir water loss soon results in not only an insufficient supply of water remaining in the reservoir for the pumps to achieve the needed high water pressure at the flexible diaphragm during the clothes water extraction cycle, but also results in a lack of water in the pumps which thereby tends to result in expensive pump impeller and inside pump housing damage.

This problem is particularly troublesome in commercial laundries where the volume of clothing being laundered is such as to provide substantially continuous repetitive clothes water extractions to batches of laundered wet clothing throughout the work day. Thus even very small leaks result in expensive down time and expensive servicing by technically trained personnel. The present invention constitutes a significant advance in the art in that it overcomes this problem by incorporating into the clothes water extracting machine a structure for automatically compensating for such leakage of reservoir water. The present invention thereby not only prevents damage to costly equipment from inadequate reservoir water supply, but also reduces the need for frequent monitoring of the machine by high priced technically skilled personnel. Additionally, the invention solves this problem with relatively inexpensive commercially available components as a relatively simple modification to existing clothes water extracting machines.

Accordingly it is an object of the present invention to provide an automatic servo arrangement for maintaining a sufficient supply of reservoir water at all times to meet the pumping needs of the clothes water extracting machine during each clothes water extracting cycle.

Another object is the provision of a relatively simple and inexpensive arrangement for automatically replacing reservoir water lost by leakage.

And a further object is the provision of a circuit arrangement which may relatively easily be installed in existing flexible diaphragm type clothes water extracting equipment as well as incorporated into equipment in process of manufacture.

And a still further object is the provision of an electric servo system arrangement for automatically maintaining a proper reservoir water supply which is relatively inexpensive, substantially fool proof and trouble free in its operation.

SUMMARY OF THE INVENTION

In a preferred embodiment of the invention a structure for modifying a laundry wet clothes water extracting machine of the type having a flexible diaphragm with an outer and inner surfaces and the inner surface forming a receptacle for receiving wet cloths for extraction of water therefrom by pump arrangement pressurably applying water from a water storage reservoir to the outside surface of the diaphragm and thereby cause the diaphragm to compress against the clothes and squeeze the clothes water therefrom and thereafter returning the reservoir water back to the reservoir, includes the combination of a water valve having an inlet for coupling to a water supply source and an outlet for coupling to the reservoir, an electrical solenoid coupled to the water valve for selectively opening and closing the water valve to flow of water from the water supply to the reservoir, an electric circuit coupled to an electric energy source and the solenoid, and a reservoir float operable switch in the electric circuit for selectively closing the circuit from the power source to the solenoid so as to cause the water valve to open for water flow when the water level in the reservoir falls below a safe level needed for pressurable supply to the flexible diaphragm during the clothes water extraction cycle and to open the circuit from the power source to the solenoid so as to close the water valve to water flow when the water level in the reservoir has risen to a preselected level suitable for safe pump operation.

By selecting the solenoid and circuit components for 24 volt operation, electrical shock danger to operating personnel is minimized.

By making all of the circuit components and couplings water tight, installation anywhere on the clothes water extracting machine becomes feasible without electrical shock danger to machine operators and short circuiting problems are minimized even where accidental water spillage may occur.

DESCRIPTION OF THE DRAWINGS

The features of the invention which are believed to be novel are set forth with particularity in the apended claims. The invention and the features, objects and advantages thereof will be better understood from the following description in conjuction with the accompanying drawings in which like reference numbers identify like components, and in which:

DESCRIPTION OF THE ILLUSTRATIVE EMBODIMENT

Figure 1:
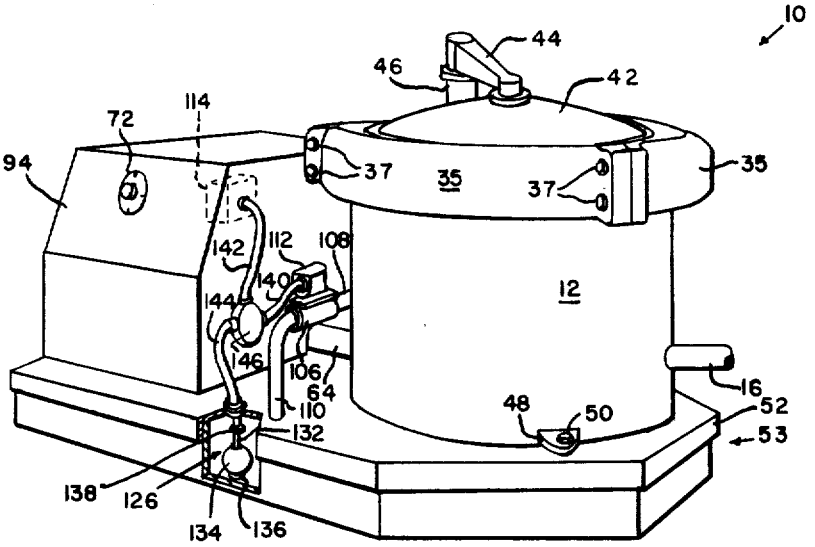
FIG. 1 is a perspective view of a flexible diaphragm clothes water extracting machine of the type having a water reservoir and modified with a servo water supply arrangement to achieve structure and operation in accordance with the present invention, the reservoir being shown with partially cut away section to more clearly show construction.

A conventional flexible diaphragm laundry wet clothes water extracting machine of the type having a water storage reservoir and with structural modification and operation in accordance with the present invention is designated generally by the numeral 10. The outside appearance and configuration is shown in FIG. 1 and details of structure are shown in partially schematic and partially block form in FIG. 2 for better understanding construction and mode of operation thereof. The illustrative embodiment in FIG. 1 is that of a conventional clothes water extracting machine available under the name of Hydraxtor from The Hydraxtor Company located in Molin, Ill. and modified in accordance with the present invention. Only such portion of the basic machine is shown in FIG. 1 and schematically in FIG. 2 as is needed to the understanding of the structural modification and operation in accordance with the present invention and which will become apparent from the following description.

The clothes water extracting machine 10 has a water extractor tub 12 comprised of an outer rigid metal container 14 at one side of the lower portion of which is a discharge pipe 16 for clothes water waste from a passage or space 18 between the cylindrical wall of the outer container 14 and an inner rigid cylindrical metal container 20. At the top of the inner container 20 is an outwardly projecting flange 22 making contact with the inside wall of the container 14 and having openings or holes 24 about its periphery. Inwardly of the holes 24 is a rigid metal ring 26 which is fixed by screws (not shown) to the flange 22 to clamp in place the upper rim 28 of flexible diaphragm 30 made of such flexible plastic material as rubber and having an inner surface 32 forming a receptacle 34 for receiving wet clothes whose water is desired to be extracted. The upper portion of the outer cylindrical metal container 14 has an inwardly extending lip 36 with inwardly extending lugs 38 spaced about the inside periphery for permitting similar lug extensions 40 on the outer periphery of a cover 42 so that the cover 42 may be removed when desired by rotating the cover 42 through a slight angular distance to align the cover lugs 40 with the spaces between the lip lugs 38. The cover 42 may be alternatively locked in place by slight angular rotation to align the cover lugs 40 directly beneath the lip lugs 38. It should be noted that while in FIG. 2 the tub 12 is shown in cross section as a single piece construction for simplicity of illustration, the actual embodiment of the tub 12 in FIG. 1 shows the upper portion of the tub 12 as comprised of arcuate sections 35 fixed together by screws 37 for purposes of practical manufacturing convenience. Also, the FIG. 1 embodiment has a davit arm 44 with one end fixed to the cover 42 and the other end mounted on a davit support 46 for facilitating the removal of the cover 42 and thereby permitting insertion and removal of batches of clothes from the flexible diaphragm receptacle 34.

Figure 2:
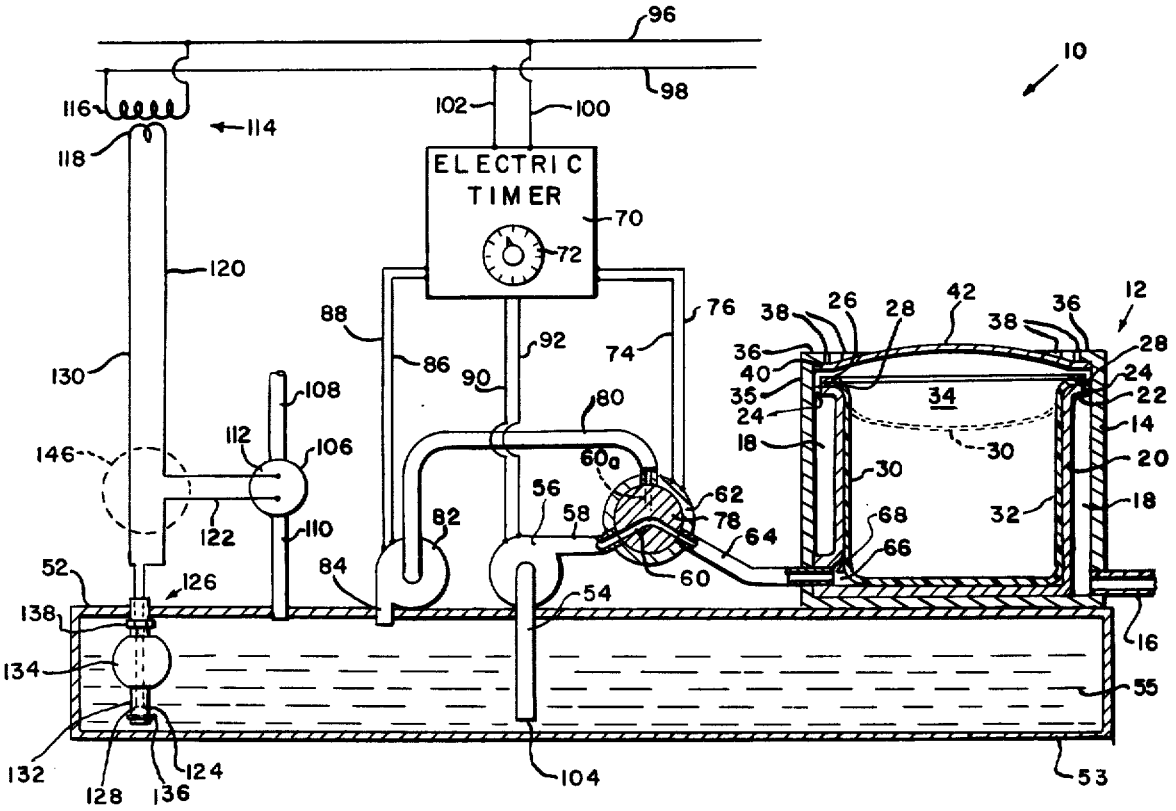
FIG. 2 is a partially schematic and partially block diagram with some members shown in cross section to illustrate sufficient aspects of the construction and principles of operation of the FIG. 1 embodiment for more clearly understanding the present invention.

The bottom of the tub 12 has lugs such as the lug 48 (FIG. 1) for fastening by screws such as screw 50 to the top or cover 52 of a reservoir 53 storing water 55 (FIG. 2) which may be pumped through an inlet pipe 54 and combination pump and electric motor 56, through a pump outlet pipe 58 and water valve passage 60 of a conventional electrically operated water valve 62 and a water pipe 64 to a space 66 between the outer surface 68 of the flexible diaphragm 30 and the rigid cylindrical container 20 so as to cause the flexible diaphragm forcibly against the wet clothes, for example to the position shown by the broken lines 30 in FIG. 2 to thereby squeeze the wet clothes against the underside of the cover 42 with the clothes water therefrom passing through the openings 24 in the flange 22 and the space 18 from whence it is discharged through the drain pipe 16 as waste.

After a sufficient period of squeezing as described above wherein the clothes water is extracted from the clothes in the receptacle 34, a conventional electric timer 70, in which the desired extraction period is set on a timer dial 72, energizes the electrically operated water valve 62 through electric cables 74 and 76 to cause the inner valve member 78 of the water valve 62 to rotate to the position shown by the broken lines **60*a* wherein the valve passage 60 becomes aligned with the water pipe 64 and a suction pipe 80 leading to a combination suction pump and electric motor 82 having an outlet pipe 84 for directing reservoir water flow from the space 66 in tub 12 back into the reservoir 53. Electric cables 86 and 88 couple the electric motor of the suction pump 82 to the electric timer 70 for operation of the suction pump simultaneously with and during the period when the timer 70 aligns the valve passage 60 with the pipes 64 and 80 respectively. The resulting return of the reservoir water from the space 66 back to the reservoir 53 thus removes pressure from the flexible diaphragm 30 and permits removal of the clothes from the receptacle 34 and the insertion of a fresh batch of wet clothes to the receptacle 34** for a similar extraction cycle.

Electric cables 90 and 92 couple the electric motor of the pressure pump 56 to the electric timer 70 where electric power to the pressure pump 56 is discontinued during the period when the suction pump 58 is in operation.

The electric timer 70, combined pressure pump and electric motor 56, electrically operated water valve 60, combined electric motor and suction pump 82, and the associated pipes and electric cables are all inclosed in a housing 94 (FIG. 1) fixed to the top 52 of the reservoir 53. Electric power to the timer 70 and other electrical equipment is obtained from conventional commercial power lines 96 and 98, normally at 220 volts A.C., to which the electric timer is coupled by electric cables 100 and 102 respectively.

It will be noted that in the event a leak occurs in the system carrying the reservoir water 55, and particularly in the event of a puncture occuring in the flexible diaphragm 30 from a sharp instrument such as a pin or nail inadvertently left in clothes which are squeezed in receptacle 34, the reservoir water 55 will leak through such puncture in diaphragm 30 and flow through the holes 24 and be discharged to waste through the drainpipe 16. Even in the case of small punctures in the flexible diaphragm 30, repetitive water extraction cycles as explained above will eventually cause loss of reservoir water 55 to a level below the opening 104 (FIG. 2) of the inlet pipe 54 and result in loss of water load in the pressure pump 56 and cause damage to the pump impeller and the internal face and body of the pressure pump as well as down time of the machine until the malfunction is corrected. To prevent such malfunction, the clothes water extracting machine 10 has been modified to incorporate a servo water supply system comprised of a water valve 106 having an inlet pipe 108 coupled to a conventional pressurized water supply source and an outlet pipe 110 fixed through the top 52 of the reservoir 53 and a solenoid operable at 24 volts A.C. for selectively opening and closing the water valve 106 to flow of water from the inlet pipe 108 through the outlet pipe 110 to the reservoir 53. A step-down transformer 114 having a primary 116 coupled across the 220 volt power lines 96 and 98, has a secondary 118, one side of which is coupled by electric cable 120 to one of the terminals on the solenoid 112, the other terminal of which is coupled by electric cable 122 to one contact 124 of a magnetically operated reed switch 126. The other contact 128 of the reed switch 126 is coupled through an electric cable 130 to the other side of the step-down transformer secondary 118. The reed switch contacts 124 and 128 are incased in a non-magnetic water tight cylindrical casing 132 on which is a slidably mounted spherical float member 134 whose sliding movement is limited between a lower stop member 136 and an upper stop member 138. The spherical float 134 carries therein a magnet in position such that when the float 134 approaches the lower stop member 136 it causes the reed switch contacts 124 and 128 to close so as to complete the circuit from the secondary 118 across the solenoid 112, thereby causing the solenoid 112 to open the valve 106 to permit flow of water from the inlet pipe 108 through outlet pipe 110 to the reservoir 53. As the level of reservoir water 55 rises, the float 134 is also caused to slide upwardly on the cylindrical casing 132 until a level is reached wherein the magnet in the float 134 causes a disengagement of the contacts 124 and 128, thereby breaking the circuit from the transformer secondary 118 to the solenoid 112 which causes the valve 106 to close and shut off the flow of water from the inlet pipe 108. The space between the lower stop member 136 and the upper stop member 138 is adjusted and set at a position with respect to the opening 104 of the inlet pipe 54 such that before the level of water 55 in the reservoir 53 falls below the inlet 104 of the inlet pipe 54, the float 134 will cause contacts 124 and 128 to close and cause the solenoid 112 to open the valve 106 for replacement of water in the reservoir 53 to a safe level, at which level the float 134 will have reached the upper stop 138 and caused the contacts 124 and 128 to open and break the circuit to the solenoid 112 and thereby close valve 106 and stopping further flow of water from the pipe 108. It will be noted that the setting of the upper stop member 138 is such that the flow from inlet pipe 108 will be stopped at a level of reservoir water 55 below the top 52 leaving sufficient capacity in the reservoir for return of water still in the space 66 in tub 12.

Electric cables 120, 122 and 130 (FIG. 2) are inclosed in water-tight conduits 140, 142 and 144 (FIG. 1) and coupled to the respective electrical components with water-tight couplings, including a water-tight junction box 146 to thereby, in combination with the low operating voltage of the servo circuit, virtually eliminate the possibility of shock injury to operating personnel as well as possibility of short circuits even under conditions of inadvertent water spills.

A combined solenoid 112 and water valve 106 suitable for use in the present invention is commercially available under the trademark ASCO from the Automatic Switch Company, Fordham Park, New Jersey. A switch 126 suitable for use in the present invention is commercially available as type number 01950 under the trademark GEMS from the Gems Division, DeLavel Turbine Co., Farmington, Connecticut.

This invention is not limited to the particular details of construction and operation described as equivalent will suggest themselves to those skilled in the art. For example, modification of the reservoir type clothes water extracting machine disclosed in U.S. Pat. No. Re. 23957 in manner described herein is within the contemplation and spirit of the present invention and would be just as applicable in FIG. 1 under a 3 wire three phase power system and a venturi suction arrangement in place of the two wire power system and centrifugal suction pump arrangement shown in FIG. 2.

What is claimed is:

1. In a laundry clothes water extracting machine of the type having a flexible diaphragm with an outer and inner surfaces and the inner surface forming a receptacle for receiving wet clothes for extraction of water therefrom, a water storage reservoir, pump means for pressurably applying the reservoir water from said reservoir about the outside surface of the diaphragm to thereby cause the diaphragm to compress against the clothes and squeeze the clothes water therefrom and thereafter return the reservoir water to the reservoir, and said pump means having a reservoir water intake opening positioned at a depth in said reservoir such that under normal non-leaking operating conditions said intake opening will continue to be immersed in said reservoir water below the reservoir water level reached when the amount of water remaining in said reservoir has been diminished by the amount of reservoir water applied against said diaphragm, the combination of a water valve having an inlet for coupling to an external water supply source which is different from that exhausted from said diaphragm and an outlet coupled to said reservoir, electrically energizable means coupled to said water valve for selectively opening and closing said water valve to flow of water from said external water supply source to said reservoir, electric circuit means coupled to said electrically energizable means for applying electrical energy from an electric power source to said electrically energizable means, and a reservoir float operable switch in said electric circuit means positioned with both said switch and float in said reservoir for creating a closed electric circuit between said electric power source and said electrically energizable means at a first water level in said reservoir which is above said reservoir water intake opening and below said diminished reservoir water level and creating an open circuit between said electric power source and electrically energizable means at a second water level in said reservoir to supply additional water from said external water supply to a level which is above said first reservoir water level which leaves sufficient remaining capacity in said reservoir for the return of reservoir water applied against said diaphragm to thereby prevent injury to components of said machine from lack of reservoir water.

2. The combination as in claim 1 wherein said electrically energizable means is of a low voltage operating type for selectively opening and closing said water valve, and said electric circuit means includes means for reducing the voltage from a conventional commercial line voltage source to a low voltage compatible with said low voltage energizable means.

3. The combination as in claim 1 wherein said electrically energizable means is structured for operation at a voltage no greater than 25 volts A.C. and said electric circuit means includes a step-down transformer to effect said operation voltage from a conventional commercial line voltage A.C. source.

4. The combination as in claim 1 wherein said reservoir float operable switch is a magnetically sensitive reed switch having electrical contact elements which close and open in response to proximity of a magnet, and a float carrying a magnet for selectively opening and closing said electrical contacts at corresponding selective water levels in said reservoir.

5. The combination as in claim 1 wherein said circuit means are incased in water-tight coverings for providing safety from electric shock and short circuiting in the presence of water spills.

* * * * *